US005341888A

United States Patent [19]

Deschutter

[11] Patent Number: 5,341,888

[45] Date of Patent: Aug. 30, 1994

[54] DRILLING TOOL INTENDED TO WIDEN A WELL

[75] Inventor: Rene Deschutter, Linkebeek, Belgium

[73] Assignee: Diamant Boart Stratabit S.A., Brussels, Belgium

[21] Appl. No.: 861,868

[22] PCT Filed: Dec. 12, 1990

[86] PCT No.: PCT/BE90/00069

§ 371 Date: Aug. 17, 1992

§ 102(e) Date: Aug. 17, 1992

[87] PCT Pub. No.: WO91/09202

PCT Pub. Date: Jun. 27, 1991

[30] Foreign Application Priority Data

Dec. 19, 1989 [BE] Belgium ..... 8901355

[51] Int. Cl.[5] ..... E21B 10/44

[52] U.S. Cl. ..... 175/323; 175/325.5

[58] Field of Search ..... 175/323, 325.1–325.7; 408/191, 224, 713

[56] References Cited

U.S. PATENT DOCUMENTS

| | | | |
|---|---|---|---|
| 1,282,976 | 10/1918 | Stubbs et al. | 175/325.5 X |
| 3,754,609 | 8/1973 | Garett | 175/325.2 X |
| 4,108,256 | 8/1978 | Moore | 175/325.2 X |
| 4,245,709 | 1/1981 | Manuel | 175/325.5 |
| 4,549,613 | 10/1905 | Case | 175/325.2 |
| 4,589,504 | 5/1986 | Simpson | 175/267 |

FOREIGN PATENT DOCUMENTS 159573 10/1985 European Pat. Off. .

*Primary Examiner*—Ramon S. Britts
*Assistant Examiner*—Rojer J. Schoeppel
*Attorney, Agent, or Firm*—Browning, Bushman, Anderson & Brookhart

[57] ABSTRACT

The drilling tool (1) intended to widen a drilling well bears a series of helical arms (3) resting at a first end on a first fixed flange (4) so as to be able to turn on themselves by a portion of a turn under the control of a rotating ring (9) driven by an opening mechanism (10) controlled by a variation in the pressure of the drilling fluid, while the other end of the arm (3) slides along a groove (21) provided in a second flange (5).

17 Claims, 7 Drawing Sheets

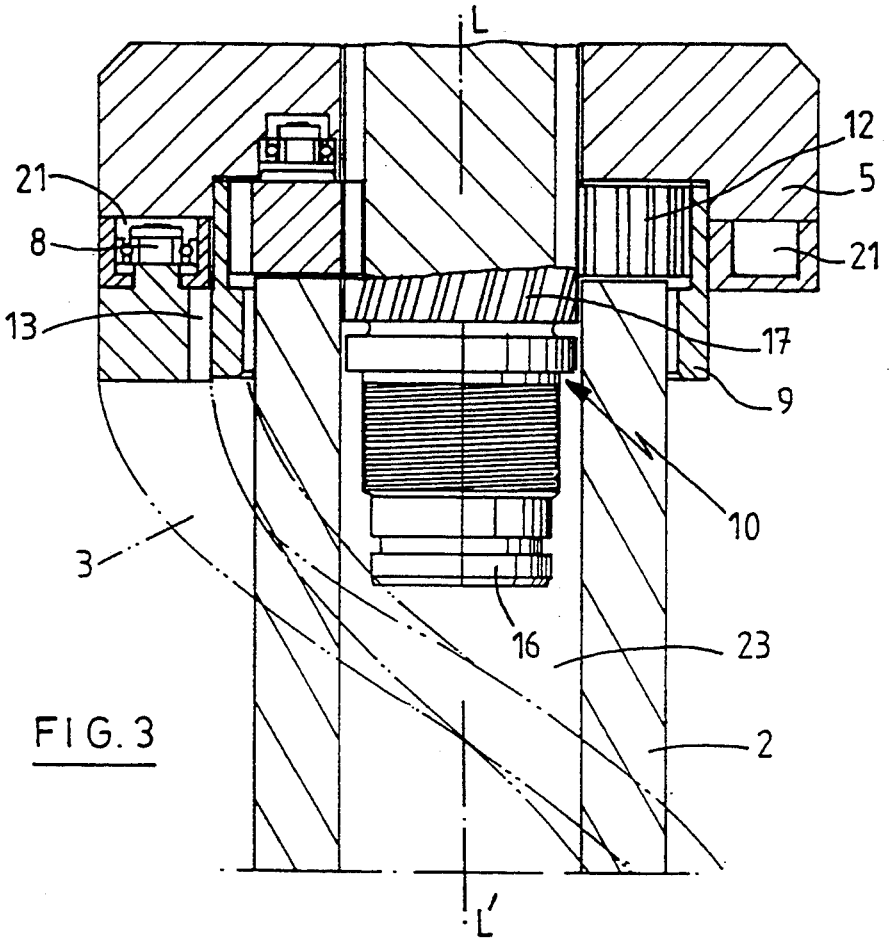
FIG. 3
FIG. 4
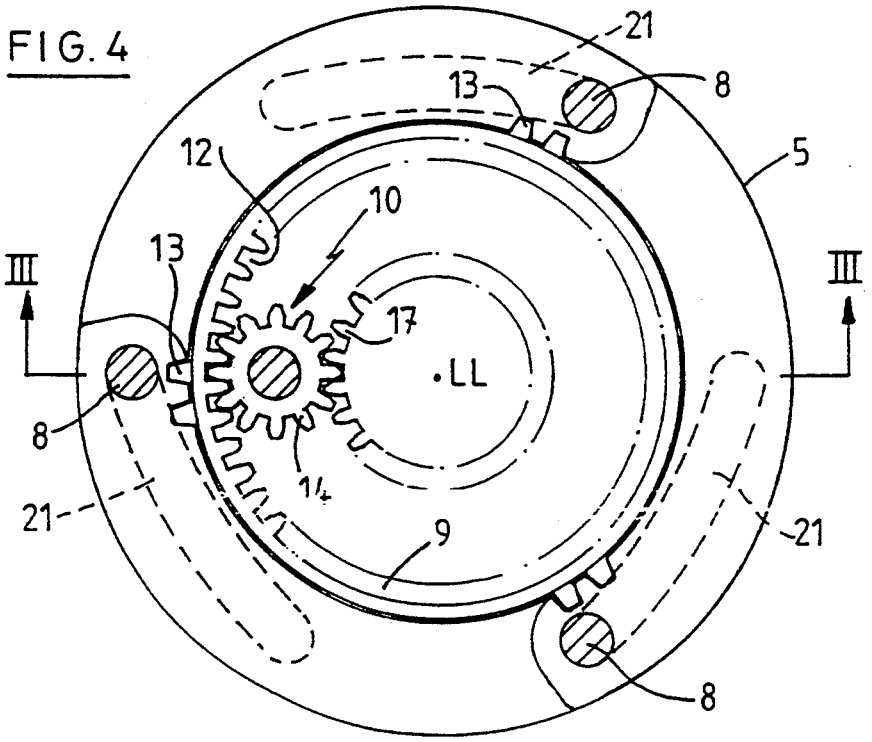

DRILLING TOOL INTENDED TO WIDEN A WELL

The present invention relates to a drilling tool intended to widen a drill well, comprising a hollow cylindrical body bordered at its ends by a first and second fixed flange, each of these flanges being provided with threaded joints so that it can be connected to a set of drill pipes.

Such a tool is used for the widening, after a time delay, of existing drill wells or, on the other hand, for immediately producing wide wells which are obtained by drilling, with a conventional drilling tool provided with a trepan or tricone bit, a narrower rough well which is directly widened into a well of larger diameter by means of a tool intended to widen a well according to the invention, which is combined with the above-mentioned conventional drilling tool.

A drilling tool intended to widen a well may also be used instead of an eccentric drilling tool or a retractable drilling tool.

The well bottom widener is designed to be introduced and lowered to a desired depth into a well drilled with an initial diameter, from which the retractable arms are unfolded to widen the well.

In the sphere of drilling, there is frequently technical and financial value in having a drill well with a large diameter in a productive zone but with a restricted diameter at the surface so that the orifice of the well can be blocked more easily should there be an ill-timed influx of pressure.

A tool for widening the bottom of a drill well is known from the document U.S. Pat. No. 4,589,504. The tool comprises a cylindrical body set into rotation by a set of drill pipes, a control device of an opening mechanism of the tool and two extendable arms. The body has a diametral cavity passing right through it. In this cavity, two extendable arms, articulated in a same longitudinal plane passing through the axis of rotation of the tool body, round pivots perpendicular to this plane.

At the rest, the arms are folded back inside the tool body. In the operating position, the arms are raised laterally to 45° so as to have a cutting edge of determined shape at the lower end of the arm, the edge being profiled so as to obtain a hole profile (preferably a curved profile) for which the vertical reaction forces exerted by the ground on the arms develop round the axis of rotation of the arm a moment of forces which tends to hold the arm out and compensates the moment of forces tending to close the arm under the influence of the horizontal lateral stresses.

In this device, the tool is lubricated by a drilling fluid supplied from the surface of the ground to the tool by means of a conduit hollowed out inside the drill pipes. The drilling liquid is supplied to the vicinity of the tool in the form of jets produced by gauged nozzles directed toward the cutting edges.

The opening of the arms is controlled hydraulically by means of the drilling liquid by increasing the flow rate of the drilling fluid pumps. As soon as the hydraulic pressure of the drilling fluid exceeds a predetermined value, for example 70 bar or $7.10^6$ Pa, the force exerted on the piston is sufficient to displace the piston against a spring toward a stable lower position. The spring opposes the displacement of the piston under the influence of the hydraulic pressure and determines an equilibrium position. The piston drives a rack which meshes with a pinion portion, raising the arms. The arms are closed automatically as soon as the hydraulic pressure diminishes due to the fact that the precompressed spring allows the piston to rise again.

The drawback of this known tool resides in the fact that significant force has to be transmitted to the arm to enable it to move away from the tool body. This force is transmitted to the arm by means of a single tooth at a notched location which weakens the arm. The employment of the tool is dependent on the destructability of the rock and on the tendency of the tool to deviate from its axis. A second drawback is the irregular shape of the widened well and the impreciseness of the diameter obtained. Furthermore, the tool suffers from a lack of lateral stability and a lack of rigidity of the arms.

The present invention aims to overcome these drawbacks. It proposes a mechanically strong tool having wear-resistant extensible interchangeable arms which allow precise adjustment of the width of the tool. It relates to a tool of the type described in the first paragraph of this specification. This tool is characterised in that it bears at least one curved arm resting at a first end on a fixed flange so as to be able to turn on itself by a fraction of a turn round an axis AA′ of a parallel stud which is inclined or skew relative to the axis of rotation of the tool, under the control of a tool opening mechanism, while the other end of the arm slides along a guide member provided in the second flange.

According to a feature of the invention, the guide member of the second flange is centred round the above-mentioned axis AA′.

According to a particular development of the invention, the axis of the stud is parallel to the axis of rotation of the tool and the guide member of the second flange is provided as an arc of a circle centred round the axis A, A′.

The guide member can be a groove provided in the flange.

The groove provided as an arc of a circle relative to the axis AA′ has an inscribed angle of between 2° and 90°, preferably between 20° and 60°.

Each articulated curved arm rests, at a first lower end, round a first stud integral with the first flange.

According to a further feature of the invention, two to six arms are distributed side by side at equal angular intervals round the core. Each cutting arm has the form of a variable-pitch helix which spreads over an arc of about 200° round the core.

In a second embodiment, the groove of the second flange is provided radially to the axis of rotation of the tool.

A special opening mechanism is formed by a helical gear of which the helical thread has an angle of inclination of between 3° and 30° and which meshes with a planet wheel having an axis of rotation parallel to that of the tool.

The planet wheel advantageously sets into rotation a ring which has external teeth meshing with each arm and internal teeth with which the planet wheel of the tool meshes.

In an embodiment given by way of example, each cutting arm is composed of three parts:

- a lower cutting region capable of hollowing out a profile of the bottom of the hole;
- a median part of which all points are equidistant from the axis of the drilling well intended to stabilise the tool in the hole, the recommended shape being that of the stabilisers. It consists of straight or constant pitch helix portions of which the angle of inclination reaches about 35° and a vertical part generally equipped with an anti-wear coating;

an upper part of which the diameter increases from top to bottom.

These features and details of the invention as well as others will emerge from the description of a particular embodiment given with reference to the accompanying drawings.

FIG. 3 shows a section along the line II' in FIG. 1.

FIG. 4 shows a cross section along the line LL' of the well bottom widener illustrated in FIG. 1.

In these figures, the same reference symbols designate identical or similar elements.

Figure 1:
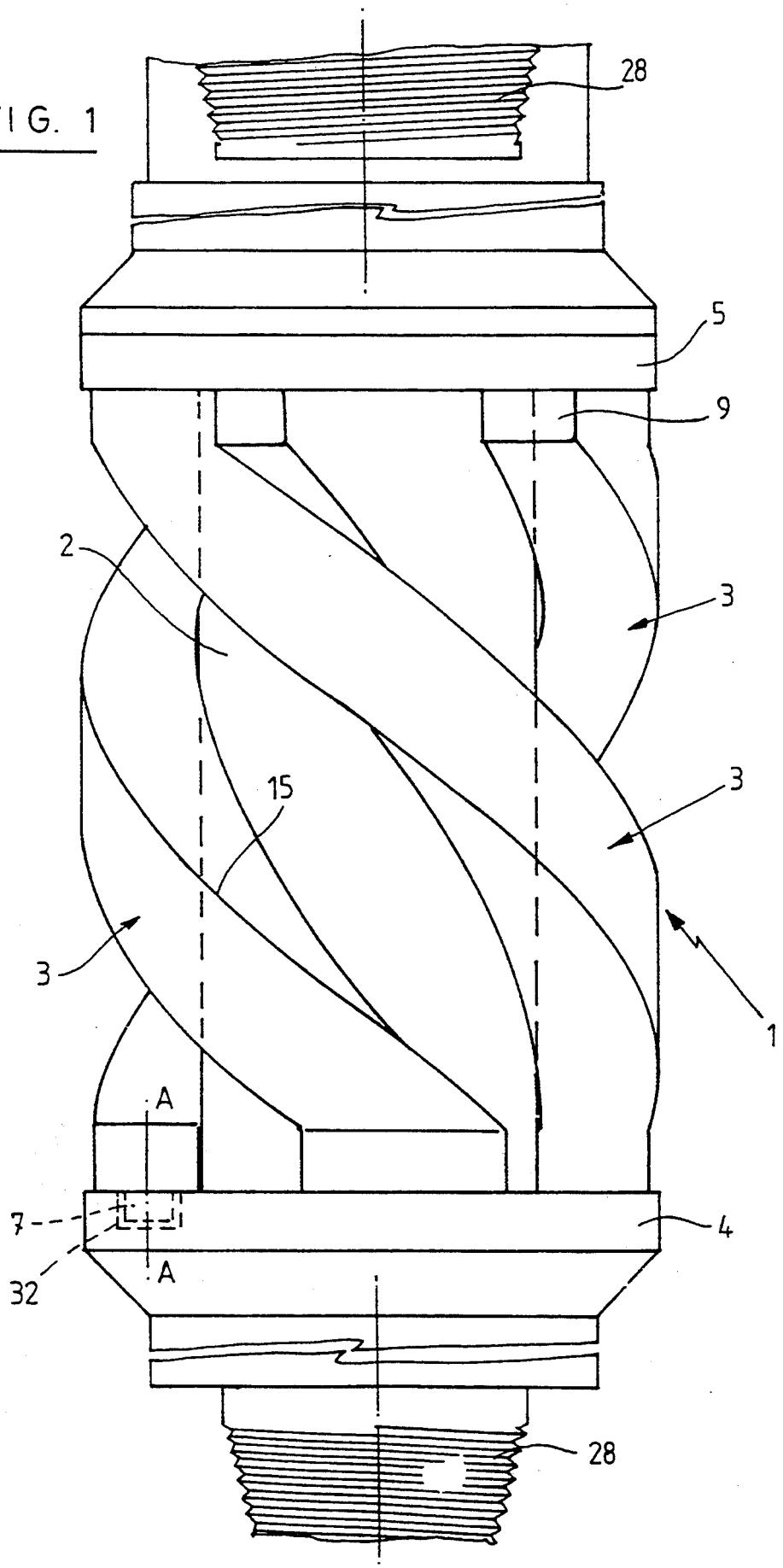
FIG. 1 shows schematically a lateral-elevation of a well bottom widener having helical arms according to the invention in the folded-up position.

As illustrated in FIG. 1, a drilling tool according to the invention designated in its entirety by reference symbol 1 comprises a hollow cylindrical body 2 defined by a cylindrical surface bordered at its ends by metallic flanges 4 and 5. The flanges serve as a fitting for a series of curved arms 3 extending along the cylindrical surface. The metallic flanges 4, 5 are integral with the cylindrical body 2 and are provided with threaded joints 28 to allow connection of the tool 1 to a set of drill pipes (not shown).

The series of curved arms can comprise up to eight arms, the arms being distributed side by side at equal angular intervals. Each curved arm has, for example, the form of a variable pitch helix which extends over an arc of about 200° round the cylindrical body. The arms are identical but are provided with differently distributed cutting elements 6 and have the same helix diameter. Each helical arm 3 has a square or rectangular cross section and is mounted so as to pivot relative to a fixed stud 7 connected integrally to the fixed flange 4.

The first fixed stud 7 is fastened in a fixing hole 32 of the fixed flange 4. The second end of the helical arm is removed by a distance corresponding to the helix diameter. The arms 3 are adjustable and can move away from the cylindrical surface by pivoting round an axis parallel to the axis of rotation of the drilling tool 1. The angular position of each helical arm 3 is controlled by angular displacement of a rotating ring 9 mounted against the upper, second fixed flange 5 integral with the frame and driven by a mechanism 10 for opening the tool 1.

The opening mechanism comprises, for example, a cam or a rotating ring 9 having internal teeth 12 and, over portions of external contour, external teeth 13 centred on the axis of rotation LL' of the tool (see FIGS. 3 and 4).

The internal teeth 12 mesh with a planet wheel 14 having a helical thread of which the axis of rotation is parallel to that of the tool. The helical thread of the planet wheel 14 has an angle of inclination of between 3° and 30°.

Each set of external teeth of the ring 9 meshes with the upper end of each arm 3 and forces it to turn on itself over a portion of a turn round the axis AA' parallel to the axis of rotation LL' (FIG. 1).

Figure 5:
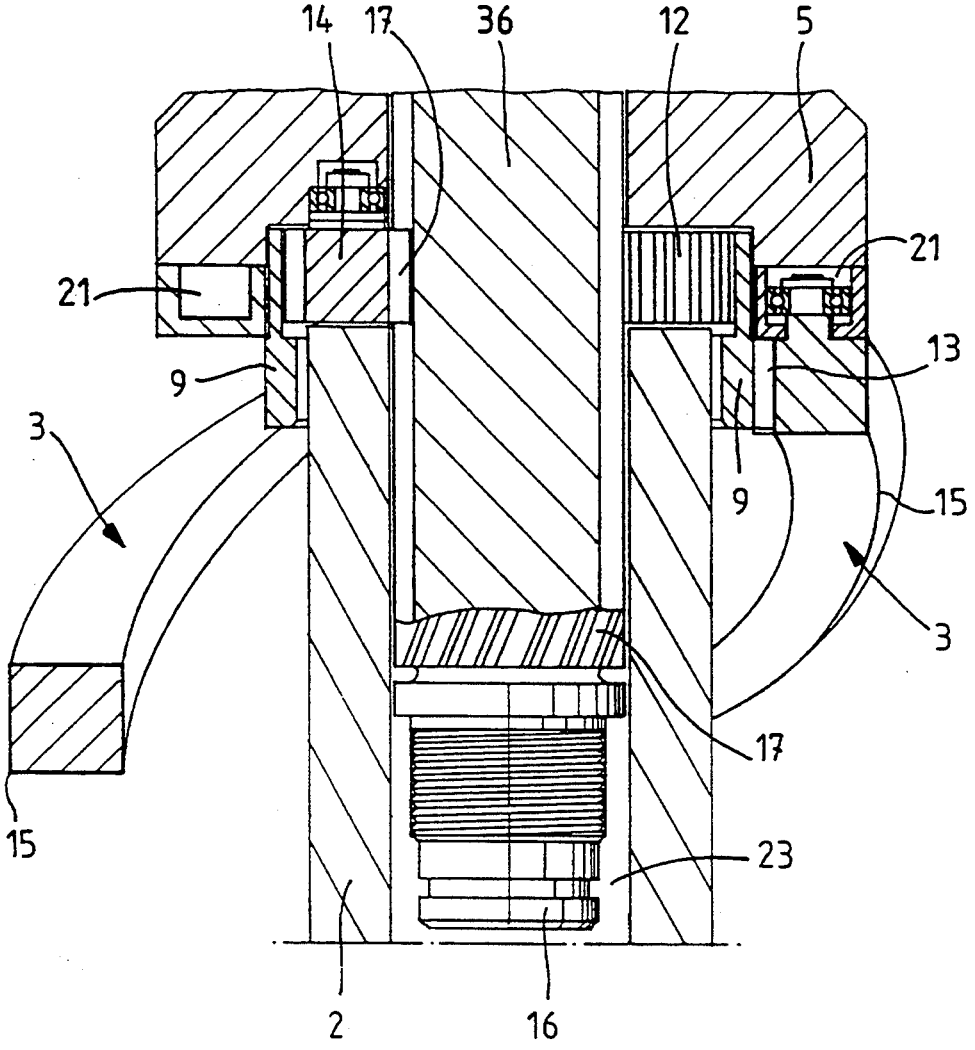
FIG. 5 shows a longitudinal section along the line IV—IV' in FIG. 4 of part of the body of the widener in the unfolded position.

The angular displacement of the second end of the arm integrally connected to the second flange 5 by a second stud 8 capable of sliding along a groove 21 provided as an arc of a circle in the second flange 5 modifies the orientation of the curvature of the arm helix so that a portion of curve projects from the cylindrical body 2 of the tool and forms a cutting edge 15 of increasing length with which the helical arm 3 attacks and progressively widens the wall of the initial hole (FIG. 5).

Figure 6:
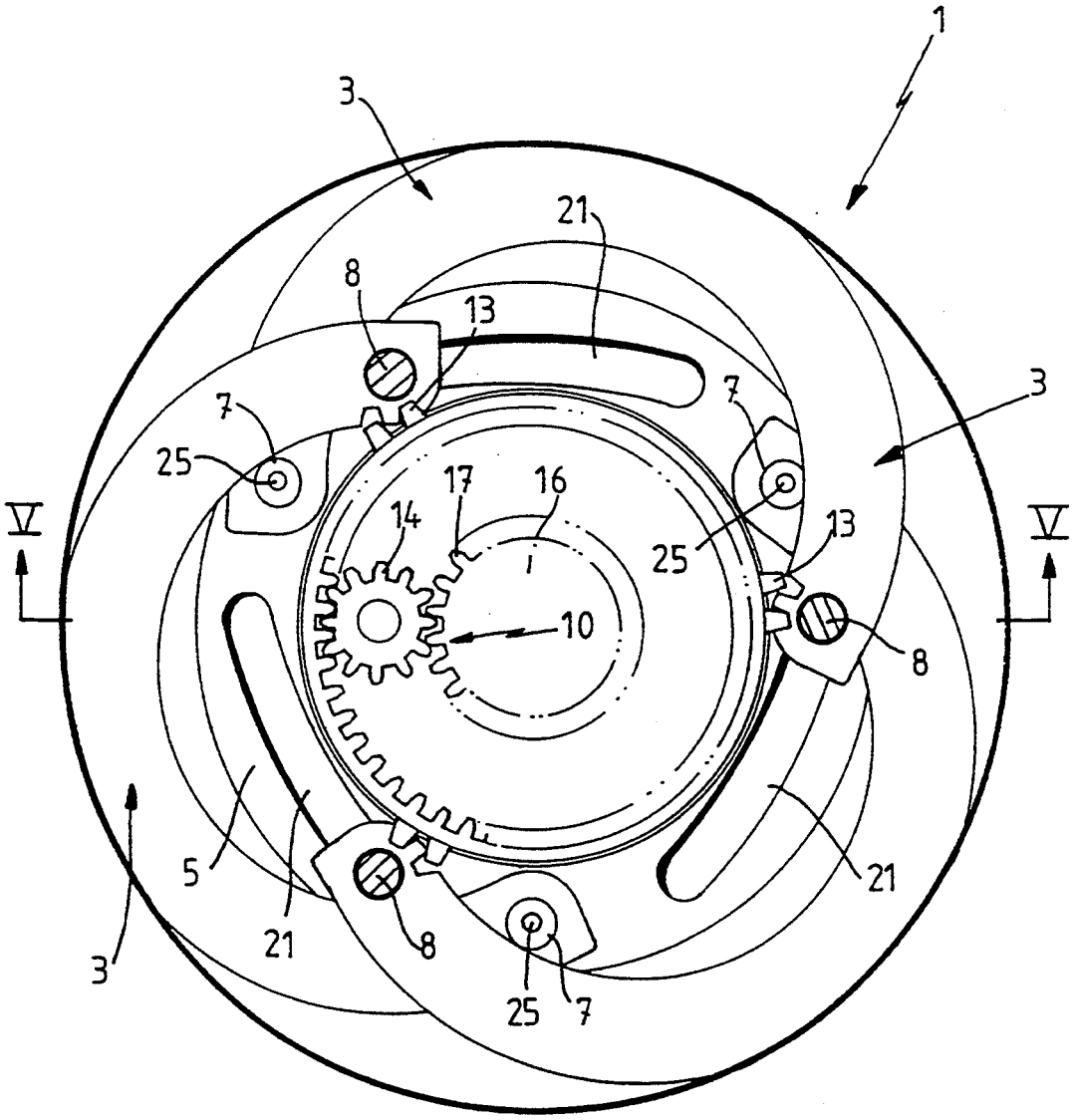
FIG. 6 shows a cross section similar to that in FIG. 4 of an interchangeable flange for wells of larger diameter intended to be mounted on the same well bottom widener as the one illustrated in FIG. 2.

The angular displacement of the ring 9 is achieved by means of the planet wheel 14 mounted on an axis parallel to that of the drill. The planet wheel 14 is set into rotation by a non-rotating piston 16 displacing a rod 36 provided with a helical gear 17. The piston 16 moves in parallel with itself under the influence of an increase in hydraulic pressure and forces the helical thread 17 of the rod 36 of the piston 16, having an angle of inclination of between 3° and 30°, to descend without turning. The pinion 14 meshes with the internal teeth of a ring centred on the axis of rotation of the tool and causes rotation of the ring which causes the stud 8 of the arm 3, mounted in a hole provided in the ring, to slide along the curved groove 21 (see FIGS. 4 and 6).

The length of the cutting edge 15 gives a measure of the performance of the tool and determines, among other things, the speed of cutting and the longevity of the tool.

Relative to known systems employing lateral arms of restricted width, the drilling tool according to the invention has a cutting edge which is at least three to five times longer than that formed by an end rim of a lateral arm in lateral extension. In the tool according to the invention, the cutting edge is formed by the useful portion of the helical arm 3 released beyond the initial diameter by the pivoting of the helical arm by a fraction of a turn on itself.

The increase of the diameter of the drilling tool is fixed by the positioning of the first and second studs 7 and 8 at the lower and upper ends of the arms 3 and the length of the groove 21 of the flange 5. This groove 21 in the form of an arc of a circle has an inscribed angle of between 2° and 120°.

The tool allows the initial diameter to be increased two and a half times with a gain in precision over the diameter formed whereas the known systems only allow a similar increase in diameter but are imprecise.

The flanges are detachably mounted. They can be replaced by a pair of flanges having increasing diameters in which there are provided grooves 21 having different curvature and opening angle so that the drilling tool can be attributed a diameter capable of varying within distinct ranges of values.

Figure 2:
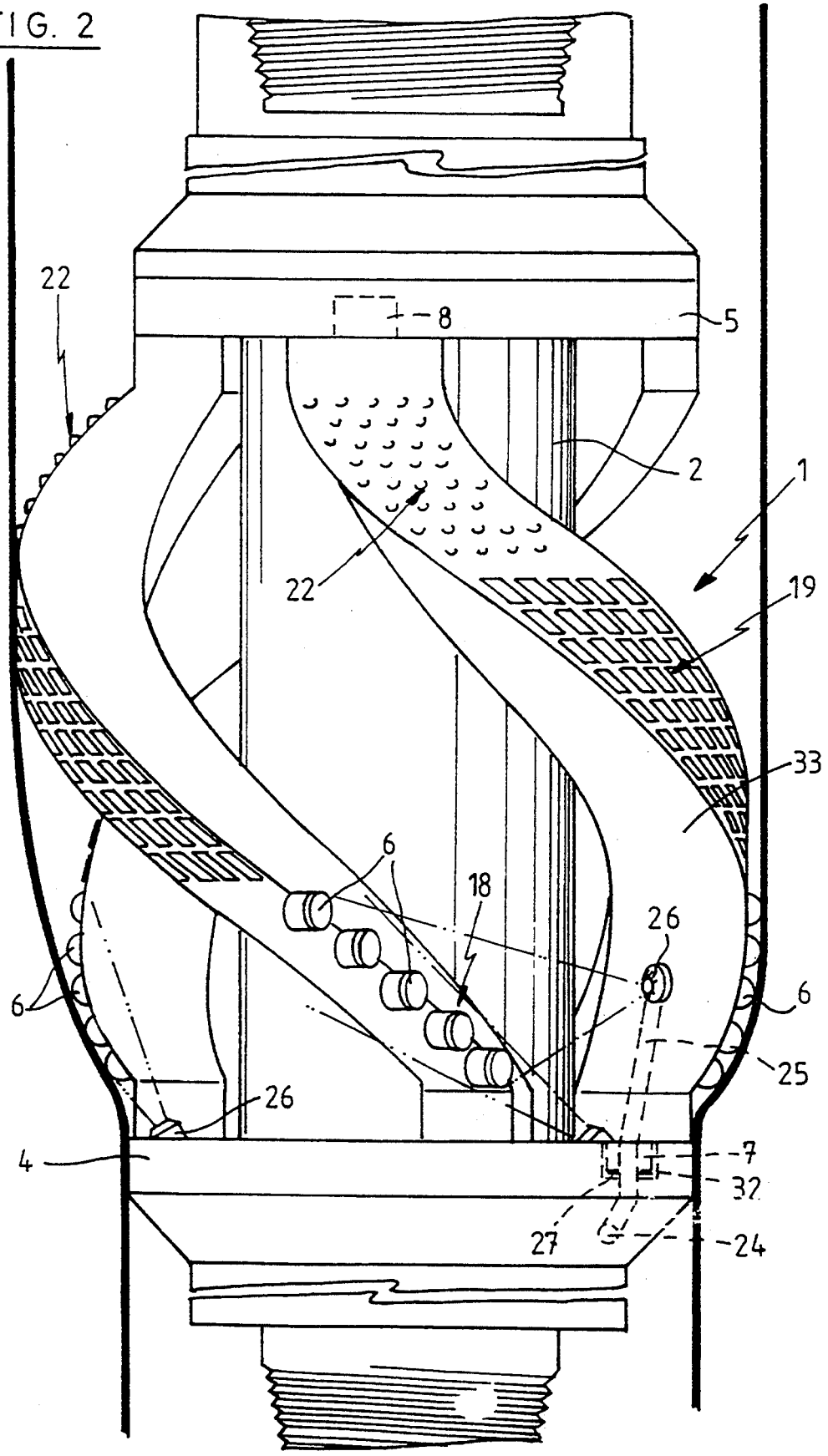
FIG. 2 shows a lateral elevation of the well bottom widener illustrated in FIG. 1, in the unfolded position.

This opening mechanism of the tool allows the increase in the diameter of the bottom of the well to be quantified by checking the angular position of the helical arms 3 (see FIG. 2).

In an embodiment, the cutting arms 3 have a curved shape composed of three parts:

1) a lower cutting part 18 having a cutting edge 15 defined by the location of the points of intersection of the profile of the bottom of the hole and of the portion of cylinder centred on the axis AA' created by the groove 21;

2) a median part 19 of which all the points are equidistant from the axis LL' of the drilling well. This is advantageously a straight section or a constant pitch helix of which the angle of inclination can reach about 35°. The median part 19 is inscribed over its entire height in a circumference of which the diameter corresponds to the widened well. The median part 19 prevents or limits any transverse movement of the widening tool relative to the axis of the well, as a stabiliser of suitable diameter would do;

3) an upper part 22 which has a diameter increasing from top to bottom and is capable of drilling upwardly so as to be able to raise the tool should it jam or deviate.

The lower part 18 is judiciously equipped with cutting elements 6 spaced along each of the cutting edges 15 according to the specific criterion of radial density such that the assembly of elements completely covers the bottom of the well and each one partially covers the furrow of a preceding element.

A central duct 23 provided in the hollow cylindrical body 2 and extended by transverse and longitudinal ducts 24, 25 provided in the flanges 4, 5 and the arms 3 lead the drilling fluid under pressure into nozzles 26 fixed to said flanges 4, 5 and arms 3 interconnected by gaskets 27. The nozzles 26 of each arm 3 are fixed on a lateral face 33 of the arm and are directed toward the cutting elements of the adjacent arms. The internal diameter of the cylindrical body 2 is selected so as to impart to the flow of drilling mud a delivery rate of 10 to 15 m/s.

The cylindrical fitting is arranged so as to allow easy disassembly not only of the curved arms 3 but also of the flanges 4, 5. The arms 3 therefore constitute wearing parts. The interchangeable flanges which are judiciously selected in a set of pairs of flanges of increasing diameters, in which there are provided fixing holes 32 and grooves 21 of different curvature and opening angle, attribute increased flexibility to the drilling tool since each pair of flanges 4, 5 is allocated a nominal diameter which can vary within a distinct range of values depending on the length of the groove of the second flange 5.

The curved arms 3 can be used immaterially with each pair of flanges 4, 5 for an entire range of widths of drilling wells.

Figure 7:
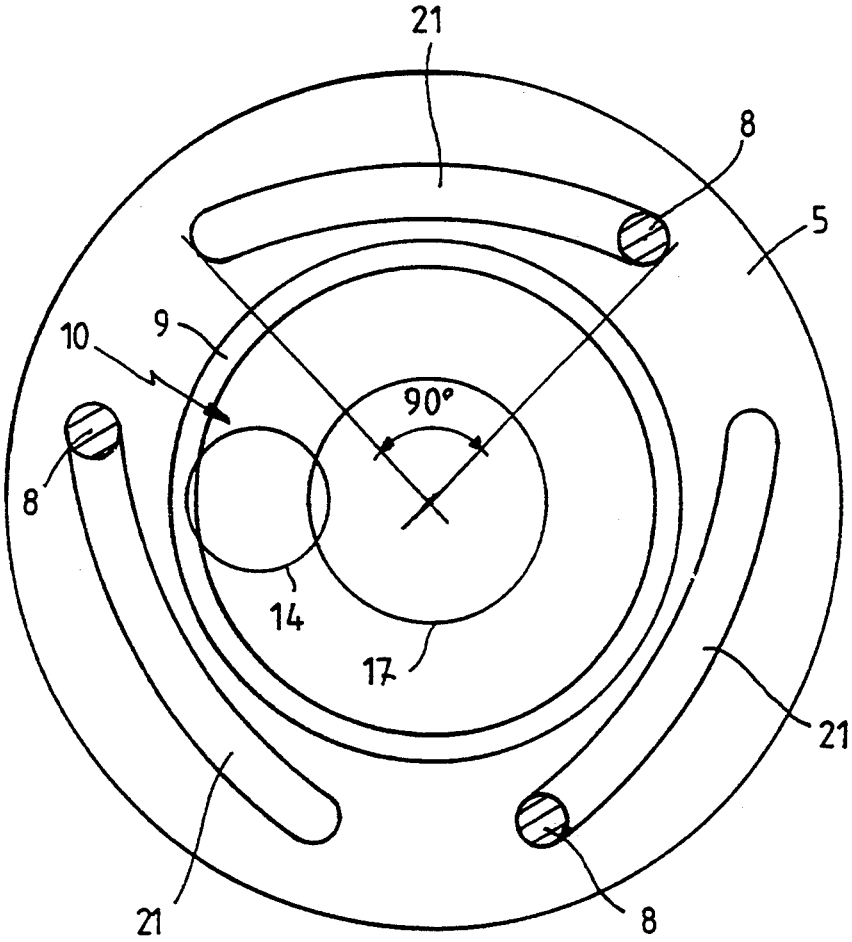
FIG. 7 is a cross section of the opening mechanism actuating the helical arms along the grooves of the upper flange.
Figure 8:
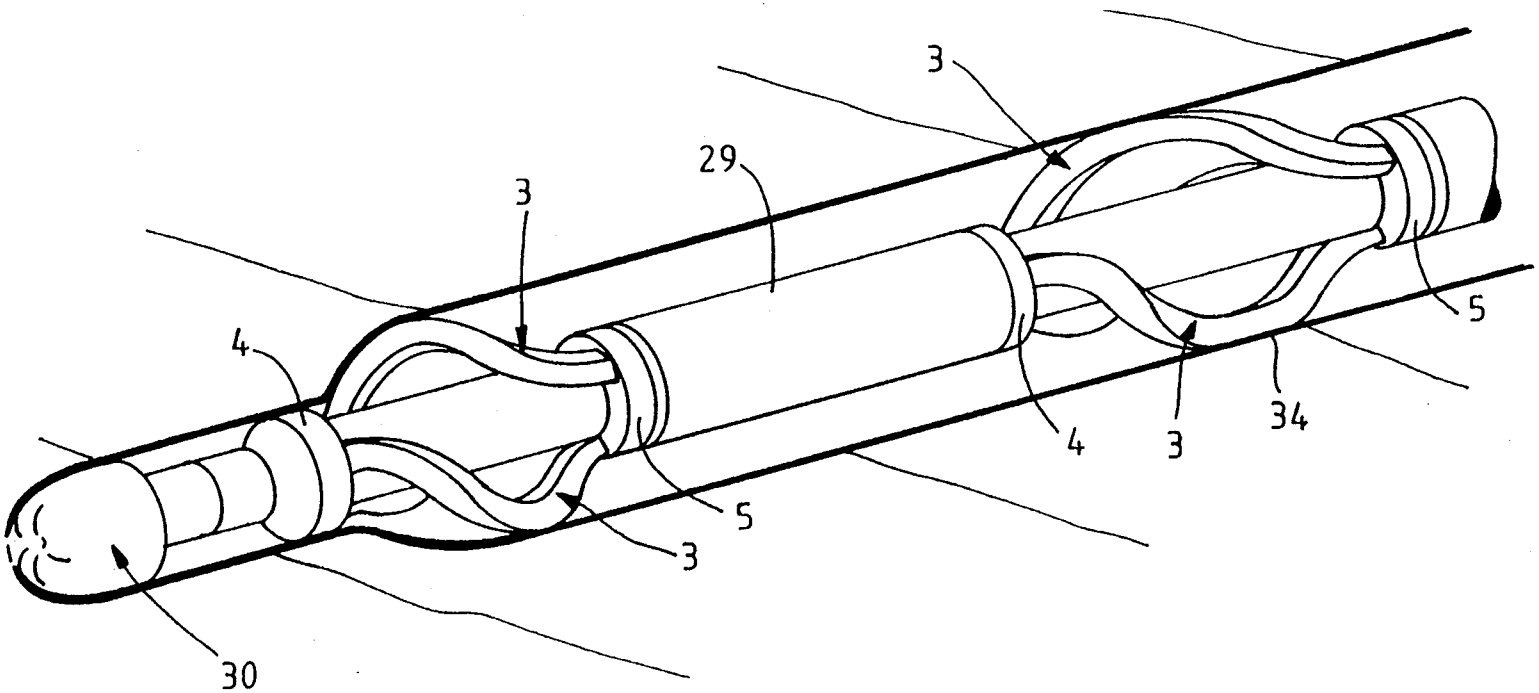
FIG. 8 is a perspective view of a double-action assembly of the well bottom widener.

FIG. 7 illustrates a double-action assembly 28 of two widening tools 1 according to the invention separated by a drill collar 29. The first tool is preceded by a drilling tool, for example a trepan having set stones 30, a bore crown or a tricone bit.

Subject to certain modifications, the tool according to the invention constitutes a stabiliser of adjustable diameter ensuring precise and/or sensitive stabilisation of the drilled well. It can also be used as a device for measuring, gauging or feeling the walls of the well.

I claim:

1. Drilling tool (1) intended to widen a drilling well comprising a hollow cylindrical body (2) bordered at its ends by a first and second fixed flange (4, 5), each flange being provided with threaded joints for connecting it to a set of drill pipes, characterised in that it bears at least one curved arm (3) resting at a first end on the first fixed flange (4) so as to be able to turn on itself by a fraction of a turn around an axis (AA'), under the control of a tool opening mechanism (10), while the other end of the arm slides along a guide member (21) provided in the second flange (5).

2. Tool according to claim 1, characterised in that the guide member (21) of the second flange (5) attributes to the lower end of the curved arm a circumferential trajectory centred around the above-mentioned axis (AA').

3. Tool according to claim 2, characterised in that the groove (21) provided as an arc of a circle relative to the axis (AA') has an inscribed angle of between 2° and 90° and, more particularly, between 20° and 60°.

4. Tool according to claim 1, characterised in that the first flange (4) is the lower flange and the second flange (5) the upper flange.

5. Tool according to claim 4 characterised in that each curved arm (3) has the form of a variable pitch helix extending over an arc of about 200° around the cylindrical body.

6. Tool according to claim 2, characterised in that each articulated curved arm (3) rests at a first lower end around a first stud (7) integral with a first flange (4).

7. Tool according to claim 6, characterised in that it comprises two to six arms (3) distributed side by side at an equal angular distance around the hollow cylindrical body (2).

8. Tool according to claim 6 characterised in that the arms (3) are interchangeable.

9. Tool according to claim 1 characterised in that the axis (AA') is parallel to the axis of rotation (LL') of the tool and in that the guide member (21) of the second flange (5) is a groove (21) provided as an arc of a circle around the axis (AA').

10. Tool according to claim 1 characterised in that the flanges (4, 5) belong to a set of pairs of flanges of increasing diameters in which there are provided grooves (21) of different curvature and opening angle so as to attribute to the drilling tool a diameter which can vary within distinct ranges of values.

11. Tool according to claim 1 characterised in that the opening mechanism (10) is formed by a helical gear of which the helical thread (17) has an angle of inclination of between 3° and 30° meshing with a planet wheel (14) having an axis of rotation parallel to that of the tool.

12. Tool according to claim 11, characterised in that the planet wheel (14) sets into rotation a ring (9) having external teeth (13) which mesh with each arm (3), and internal teeth (12) which mesh with the planet wheel (14) centred on the axis of rotation (L, L') of the tool (1).

13. Tool according to claim 1 characterised in that each cutting arm (3) is composed of three parts:

a lower cutting region (18) capable of hollowing out a profiled hole bottom, which region is equipped with cutting elements;

a median part (19) of which all the points are equidistant from the axis (L, L') of the drilling well intended to stabilise the tool in the hole, the recommended shape being that of the stabilisers and consisting of portions of straight lines or of a constant pitch helix of which the angle of inclination reaches about 35° and a vertical part (34) generally equipped with an anti-wear coating; and an upper part (22). of which the diameter increases from top to bottom.

14. Tool according to claim 1, characterised in that the hollow cylindrical body (2) allows passage of a drilling fluid, the internal diameter of the cylindrical body (2) being determined by the flow of drilling mud so as to limit the flow to a delivery rate of 10 to 15 m/s.

15. Tool according to claim 1, characterised in that the second flange (5) comprises means for measuring the displacement of at least one arm along the groove (21).

16. Tool according to claim 1, characterised in that each of the arms (3) comprises a vertical portion (34).

17. Tool according to claim 1, characterised in that the arms (3) have nozzles (26) on at least one of their lateral faces (33).

* * * * *